United States Patent [19]

Walker

[11] Patent Number: 4,521,965

[45] Date of Patent: Jun. 11, 1985

[54] HAND-DRIVEN, RECIPROCATING CAN OPENER

[76] Inventor: Leroy Walker, 4719 Rhodes Dr., New Orleans, La. 70126

[21] Appl. No.: 511,536

[22] Filed: Jul. 7, 1983

[51] Int. Cl.[3] ..... B67B 7/34

[52] U.S. Cl. ..... 30/410; 30/435

[58] Field of Search ..... 30/410, 412, 414, 443, 30/445, 446, 435, 438, 409, 400

[56] References Cited

U.S. PATENT DOCUMENTS

| | | | |
|---|---|---|---|
| 99,046 | 1/1870 | Alexander | 30/445 |
| 580,916 | 4/1897 | Westerfield | 30/446 |
| 642,850 | 2/1900 | Russell | 30/445 |
| 1,473,600 | 11/1923 | Curtis | 30/435 |
| 1,477,716 | 12/1923 | Quackenbush | 30/438 |
| 1,529,856 | 3/1925 | Woods | 30/445 |
| 2,090,898 | 8/1937 | Rettinger | 30/435 |
| 2,648,128 | 8/1953 | Tanking | 30/435 |
| 3,605,263 | 9/1971 | Simmonds | 30/410 |

*Primary Examiner*—Jimmy C. Peters

[57] ABSTRACT

A can opener for opening cylindrical metal cans by means of a reciprocating, circular motion produced by holding the can opener in the hand of the user and moving it up and down while also rotating it about a vertical axis. The can opener includes a handle at its upper end on a hollow, cylindrical shaft which includes at its bottom end a series of, for example, four radially extending arms having at their distal ends downwardly pointed, "V" shaped blades having sharp tips, and a smaller, spring-bias shaft which telescopically fits into the main shaft and which has at its lower end a magnet. The ends of the cutting blades also preferably include inverted "U" shaped hooks which engage and hold the upper, vertically extending peripheral lip of the can during the cutting operation. The cutting blades telescopically fit into the radially extending arms, so that they can be easily removed and replaced with cutting blades that provide a different effective diameter of cutting action for different sized cans.

14 Claims, 1 Drawing Figure

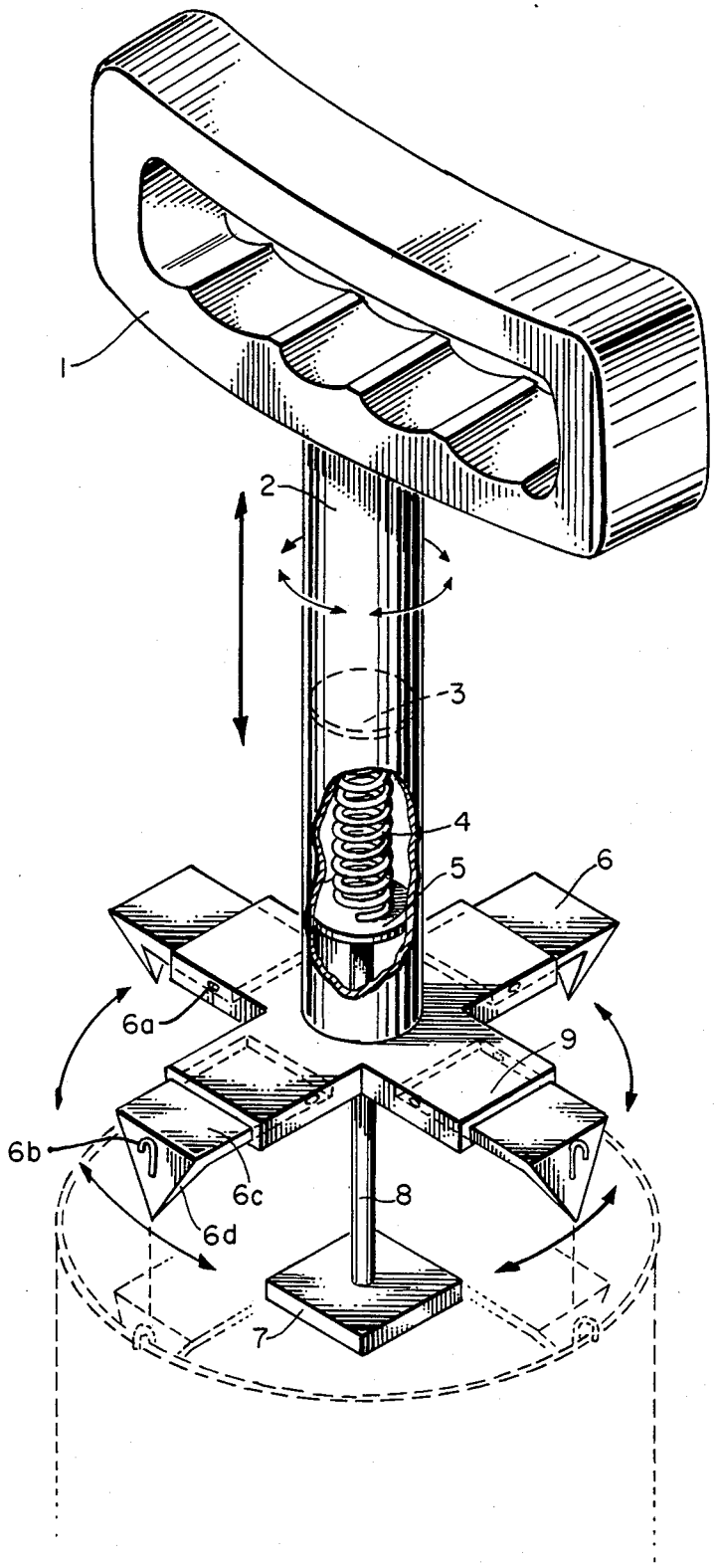
1
2
3
4
5
6
6a
6b
6c
6d
7
8
9

HAND-DRIVEN, RECIPROCATING CAN OPENER

BACKGROUND OF INVENTION

1. Field of Invention

The present invention relates to can openers, and more particularly to can openers which are hand driven to produce a complete circular cut in the top of the can in order that the circular can top can be removed from the can for access to the goods in the interior of the can. More particularly, the can opener of the present invention is directed to one which produces the cutting action by means of a vertically driven reciprocating action concurrent with a rotating action as the tips of the cutting blades are driven about the top of the can.

2. Prior Art

Can openers are well known in the art and have taken a variety of forms.

The most common, hand-operated can opener usually includes a handle which is grasped in one hand and has a rotating cutting blade wheel which bears against the can top, which rotating blade wheel is driven by a key which is rotated by the opposite hand of the user. Sometimes the wheel skips leaving an incomplete cut, and, when the blade wheel becomes dull, the entire can opener is thrown out.

Such can openers thus have not been totally effective, and the need for improvement has long existed in this art.

In contrast to this prior art approach of driving a rotating cutting blade wheel along the periphery of the can, the present invention utilizes a hand driven, reciprocating action which vertically drives the cutting blades up and down, while the can opener is likewise rotated about a vertical axis producing a complete 360 degree cut about the periphery of the can top. Such positive drive produces a more definite and stronger cutting action than achieved in the prior art.

3. General Discussion of the Invention

The present invention achieves the desired results of an improved can cutting action by utilizing a can opener having a main, hollow shaft which includes at its top a handle which can be firmly grasped in the hand of the user for positively driving the can opener up and down along with an easy concurrent rotating action of the handle about a vertical axis. At the lower end of the can opener there is included a series of radially extending arms which include at their distal ends downwardly directed cutting blades which cut the can top as the can opener is driven up and down and rotated.

Holding or engaging hooks are preferably located at the far ends of the cutting blades which are in the form of preferably inverted "U" shapes, which hook over the upper lip of the can and thereby exactly position the cutting blades as they are moved about the top of the can to produce the complete 360 degrees of circular cut. Additionally, there is preferably included at the lower end of the can opener a supplemental, can top holding shaft which includes a magnet at its bottom for magnetically holding the can top during the cutting operation. The supplemental shaft telescopically fits in to the central, hollow interior of the main shaft and is spring-biased.

The cutting blades are preferably telescopically positioned within the radial arms to allow for variation of the effective cutting diameter of the can opener by substituting different sized sets of blades for different sized cans. Alternatively, the depth of the telescoping fit between the cutting blades and the arms could be varied by inserting more or less of the shanks of the cutting blades into the interior of the radial arms to vary the effective diameter of cut.

Thus, it is a basic object of the present invention to provide a hand-manipulated, positively driven can opener which is highly effective in its cut and can be readily and easily adaptable to varying sizes of cans and which allows easy replacement of dullen blades while allowing the continued use of the main structure of the can opener.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein:

The single FIGURE of the drawings is a perspective view with a portion of the main shaft cut away to show its interior interfacing with the supplemental can top holding shaft, with the can being cut shown in phantom line and with the hooking engagement likewise being shown in phantom line, the figure also including various directional arrows indicating the movement of the can opener during the cutting process.

DETAILED DESCRIPTION OF THE PREFERRED EMBODIMENT

As is shown in the drawing, the preferred embodiment of the can opener of the present invention includes at its upper end a handle 1 which is preferably smooth in its configuration and includes an centrally open area in which the four fingers of the user's hand are inserted, with the top of the handle resting in the palm of the hand of the user. This grip allows a positive and forceful driving of the can opener reciprocably down in a vertical direction, and likewise allows for easy rotation of the handle 1 about a vertical axis until the cutting blades 6 have collectively made a three hundred and sixty degree cut around the periphery of the can.

In the preferred embodiment illustrated, it is noted that there are four radially disposed arms 9 positioned at ninety degree spacings with respect to one another, which permits a mere rotation of ninety degrees about the vertical axis in order to produce the complete three hundred and sixty degrees of cut. Of course other symmetrical placement of arms 9 are possible, using a minimum of two disposed at one hundred and eighty degrees separation from each other which would require a minimum rotation of one hundred and eighty degrees about the vertical axis to produce the complete three hundred and sixty degrees of cut.

The handle 1 is fixedly mounted on top of the main shaft 2 which is made up of a hollow clindrical piece of tubing. The main shaft 2 includes within its interior a fixed circular plate 3, which has one end of a spring 4 attached to the bottom of it. The other end of the spring 4 is attached to a moveable plate 5 which can move reciprocally up and down within the hollow body of the main shaft 2. This attachment allows the supplemental shaft 8, which includes a magnet 7 at its bottom end, to move up and down telescopically within the main shaft 2, as the can opener is reciprocatingly driven up and down by the user.

At the distal ends of the arms 9 are cutting blades 6, each of which includes a downwardly extended, sharp "V" shaped cutting edge 6B. The shanks 6C of the cutting blades telescopically extend into the open interior of the radially arms 9 and are frictionally locked into place by means of lateral side extensions 6A protruding through and locking into side openings in the radial arms 9. When it desired to change the effective cutting diameter of the can opener, the cutting blades 6 are merely pulled out of the arms 9 and replaced with another set of cutting blades having longer shanks 6C. This likewise provides an easy way of replacing dullen blades. Alternatively, of course, the structure and design of the radial arms could be varied by, for example, providing a series of side openings into which the lateral extensions 6A could be selectively positioned, thereby effectively varying the length of the shanks 6C, which extend out of the radial arms 9, to vary the effective cutting diameter.

At the very ends of the cutting blades 6 are provided inverted "U" shaped hooks, which are hooked down over the peripheral lip (note phantom line portion of drawing) to accurately position and hold the cutting blades 6 at the very perpheral edge of the can top as the can opener is driven up and down and rotated.

In operation the can opener is grasped by the handle 1 and positively driven up and down as it is rotated about a vertical axis. During this operation, the magnet 7 holds on to the can top by means of its magnetic action, while the hooks 6B properly position the tips of the cutting blades at the very periphery, with the spring 4 allowing the up-and-down movement of the main shaft and the cutting blade tips while the magnet 7 remains in holding contact with the can top. The directional arrows shown in the figure indicate the vertical or reciprocating action as well as the circular rotating action which occurs during the cutting operation.

Because many varying and different embodiments may be made within the scope of the inventive concept herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A can opener for cutting open the tops of cylindrical metal cans, comprising:

a vertically disposed, main shaft;

handle means connected to the upper portion of said shaft for grasping in the user's hand and moving the shaft vertically up-and-down and rotating it about a vertical axis;

a multiple number of radially extending arms connected to and extending out laterally away from the lower portion of said shaft;

cutting blade means located at the ends of said radial arms for cutting the can top as said main shaft is reciprocated and turned; and inverted "U" shaped hook means located at the distal ends of said radial arms for engaging and holding the upwardly extending peripheral circular lip of the can during the can opening process.

2. The can opener of claim 1, wherein there are four of said axially arms symmetrically located at ninety degree positions about said shaft.

3. The can opener of claim 1, wherein each said radial arm and its respective cutting blade means are telescopically connected together allowing for variation in the radial length of said arms and said cutting blade means and the effective diameter of the circular cut made by the cane opener.

4. The can opener of claim 3, wherein each said cutting blade means includes a shank portion which fits into the interior of its respective radial arm, there being further included lateral protrusion on said shank portions and mating openings in said arms, the protrusions being locked into said openings during the cutting operation.

5. The can opener of claim 1, wherein said cutting blade means each comprise a downwardly directed "V" shaped blade.

6. The can opener of claim 1, wherein said handle includes a main, extended body which fits into the palm of the hand of the user and has a central, laterally elongated open area into which the upper four fingers of the hand of the user are each insertable.

7. The can opener of claim 1, wherein said can holding means further includes:

can top holding means connected to and extending down from said main shaft for holding the cap top as it is being cut as said shaft is reciprocated and turned; and wherein said can holding means comprises:

a spring-biased shaft extending telescopically and moveably within the central, inner portion of said main shaft at its upper end and having a magnet at its lower end which magnetically holds the top of the can during the cutting operation.

8. A can opener for cutting open the tops of cylindrical metal cans comprising:

a vertically disposed, main shaft;

handle means connected to the upper portion of said shaft for grasping in the user's hand and moving the shaft vertically up-and-down and rotating it about a vertical axis;

a multiple number of radially extending arms connected to and extending out laterally away from the lower portion of said shaft;

cutting blade means located at the ends of said radial arms for cutting the can top as said main shaft is reciprocated and turned;

can top holding means connected to and extending down from said main shaft for holding the cap top as it is being cut as said shaft is reciprocated and turned; and a spring-biased shaft extending telescopically and moveably within the central, inner portion of said main shaft at its upper end and having a magnet at its lower end which magnetically holds the top of the can during the cutting operation.

9. The can opener of claim 8, wherein there are four of said axially arms symetrically located at ninety degree positions about said shaft.

10. The can opener of claim 8, wherein each said radial arm and its respective cutting blade means are telescopically connected together allowing for variation in the radial length of said arms and said cutting blade means and the effective diameter of the circular cut made by the cane opener.

11. The can opener of claim 8, wherein each said cutting blade means includes a shank portion which fits into the interior of its respective radial arm, there being further included lateral protrusion on said shank portions and mating openings in said arms, the protrusions being locked into said opening during the cutting operation.

12. The can opener of claim 8, wherein said cutting blade means each comprise a downwardly directed "V" shaped blade.

13. The can opener of claim 8, wherein said handle includes a main, extended body which fits into the palm of the hand of the user and has a central, laterally elongated open area into which the upper four fingers of the hand of the user are each insertable.

14. A can opener for cutting open the tops of cylindrical metal cans, comprising:

a vertically disposed, main shaft;

handle means connected to the upper portion of said shaft for grasping in the user's hand and moving the shaft vertically up-and-down and rotating it about a vertical axis;

a multiple number of radially extending arms connected to and extending out laterally away from the lower portion of said shaft;

cutting blade means located at the ends of said radial arms for cutting the can top as said main shaft is reciprocated and turned; and a spring-biased shaft extending telescopically and moveably within the central, inner portion of said main shaft at its upper end.

* * * * *